United States Patent [19]

King

[11] Patent Number: 4,955,101

[45] Date of Patent: Sep. 11, 1990

[54] BODY SCRUBBING BRUSH APPARATUS

[75] Inventor: Martin J. King, Surrey, Canada

[73] Assignees: Hope Technologies Corp.; Columbia Technology Corp., both of Vancouver, Canada

[21] Appl. No.: 381,367

[22] Filed: Jul. 18, 1989

[51] Int. Cl.[5] ..... A46B 13/06

[52] U.S. Cl. ..... 15/21.1; 15/97 R; 15/88.1; 15/97.1; 128/53; 128/50

[58] Field of Search ..... 15/21 R, 21 B, 97 R; 128/37, 47, 50, 53, 62 R

[56] References Cited

U.S. PATENT DOCUMENTS

| | | | |
|---|---|---|---|
| 4,177,535 | 12/1979 | Cole | 15/97 R |
| 4,188,682 | 2/1980 | Burglin et al. | 15/97 R |
| 4,490,871 | 1/1985 | Martin | 15/21 R |
| 4,633,857 | 1/1987 | Czeczerski | 128/53 |
| 4,704,756 | 11/1987 | Williams et al. | 128/53 |

*Primary Examiner*—Philip R. Coe
*Assistant Examiner*—Gary K. Graham
*Attorney, Agent, or Firm*—Shlesinger & Myers

[57] ABSTRACT

A body scrubbing brush apparatus comprises a base support, a brush panel having a front brushing surface, and means for non-rotatably moving the brush panel in a small orbital path relative to the base support. Such movement may be achieved with an hydraulic drive mechanism, and the entire apparatus may be mounted to the wall of a shower bath.

7 Claims, 4 Drawing Sheets

BODY SCRUBBING BRUSH APPARATUS

FIELD OF THE INVENTION

This invention relates to brushes and, more particularly, brushes for scrubbing the human body.

BACKGROUND TO THE INVENTION

The prior art reveals a variety of hydraulically or motor driven brushing devices which are variously described in broad terms as brushes, scrubbers, massagers, scratchers, bathing devices, and the like. These devices include devices that are designed to be mounted on a wall such as the wall of a shower where they are used to provide a cleansing and rejuvenating action on the body while taking a shower. However, the precise nature of such "action" may vary from one device to the next.

In some cases, the action is a reciprocating action as is disclosed, for example in U.S. Pat. No. 4,704,756 granted to Williams et al. on Nov. 10, 1987. In other cases, the action may be a rotary action as is disclosed, for example, in U.S. Pat. No. 3,091,776 granted to Roberts on June 4, 1963 (showing cylindrical brushing surfaces rotating about vertical axes), and in U.S. Pat. No. 4,151,623 granted to Steere on May 1, 1979 (showing a flat brushing surface rotating in a vertical plane). In at least one case, the action is a combined reciprocal and rotary action: see U.S. Pat. No. 4,490,871 granted to Martin on Jan. 1, 1985.

While reciprocating actions or rotary actions are effective to a degree, they do not achieve what may be described as a true scrubbing action where any given spot that is being brushed is brushed from several directions. To achieve improved cleansing action, it is desirable to brush from several different directions because the hold or stick of dirt, grime, and the like may be weaker in some directions than others.

The scrubbing effectiveness of a pure reciprocating action is limited because any given spot that is being brushed is brushed from only two directions that are opposed 180° to each other (viz. back and forth, up and down, etc.). The scrubbing effectiveness of a pure rotary action (rotation about a fixed axis) is likewise limited, if not more so. In the case of pure rotary actions, any given spot will be brushed from only one direction (viz. the direction of rotation of the brush). Furthermore, with a rotary brush of the type where the brushing surface rotates in a fixed plane, the rate of brushing action will vary from zero to a maximum depending on distance from the axis of rotation. In general, it may be noted that rotary actions as disclosed by Roberts, Steere and Martin, supra, when used in a shower bath, can be undesirably prone to spraying soapy water from the outer perimeter of the brushes moving at relatively high speed.

If reciprocating action is combined with rotary action as contemplated by Martin, supra, the scrubbing effectiveness is somewhat improved. Any given spot on the body may in fact be brushed from several directions, but the effectiveness will vary across the brushing surface from near zero at the rotary axis of the brush to a maximum at its outer perimeter. Thus, the scrubbing effectiveness that is achieved is not achieved uniformly across the full brushing surface. Further, as indicated above, the rotary action of the Martin brush is apt to create an undesirable spray of soapy water.

It is an object of the present invention to provide a new and improved body scrubbing apparatus that provides a true scrubbing action where any given spot that is being brushed is brushed from several directions.

It is a further object of the present invention that such scrubbing action be uniform across the full brushing surface.

Yet another object of the present invention is to provide a new hydraulic drive mechanism for such scrubbing apparatus.

SUMMARY OF THE INVENTION

In accordance with a broad aspect of the present invention, there is provided a body scrubbing apparatus comprising a base support, a brush panel connected to the base support, and an hydraulic driving means for moving the brush panel in relation to the base support. The brush panel has a front brushing surface. The movement of the panel is a non-rotational movement in an orbital path about an axis extending perpendicular to the base support, and the area described within the orbit path is substantially less than that of the brushing surface.

With such movement, any given point on the brushing surface moves in a relatively small loop, and it will be appreciated that such movement is unlike rotary motion. From the perspective of a fixed point on a body that is being brushed, a continuum of points on the brushing surface will pass over the fixed point from various directions. Thus, action akin to a true scrubbing action is achieved. Further, since each point on the brushing surface follows a similar localized path, the brushing action is uniform across the full brushing surface.

The foregoing and other features of the invention will now be described with reference to the drawings.

DETAILED DESCRIPTION

Body scrubbing brush apparatus 1 illustrated in the Figures comprises a base support 20 and a brush panel 40 connected to the base support, the base support itself being mounted within an outer frame 5. Outer frame 5 enables the entire apparatus to be mounted to the wall of a shower bath or the like (not shown) with the brush panel then being held in a vertical plane.

Figure 1:
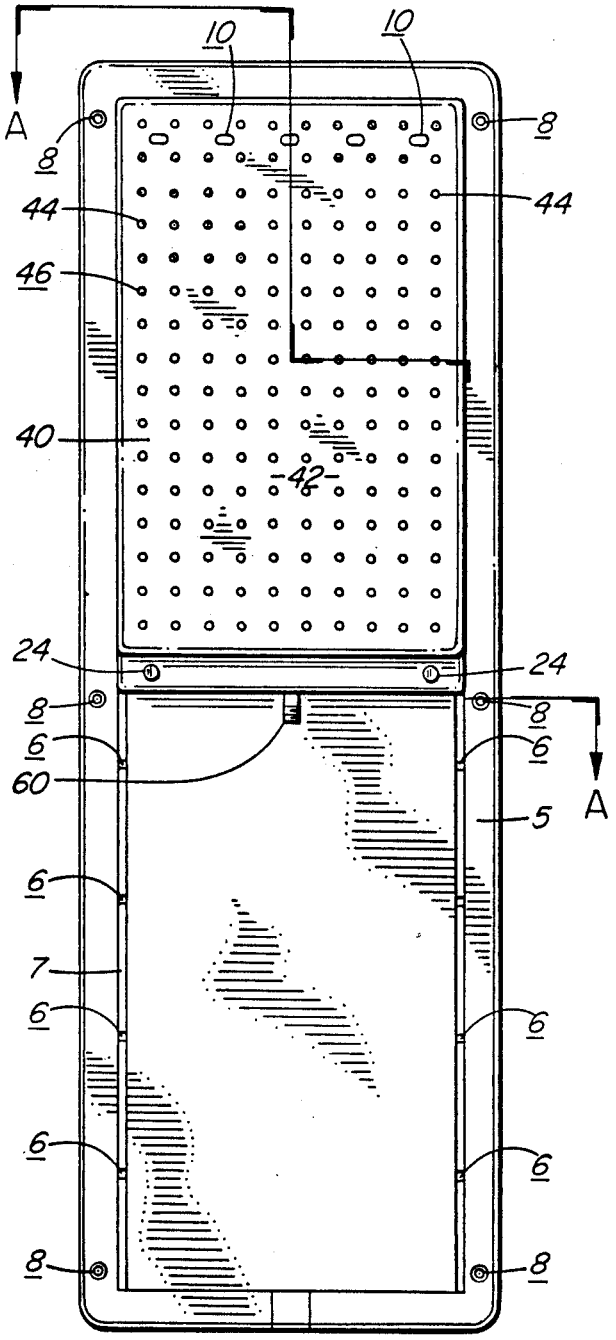
FIG. 1 is a front elevation view of a body scrubbing brush apparatus in accordance with the present invention.
Figure 2:
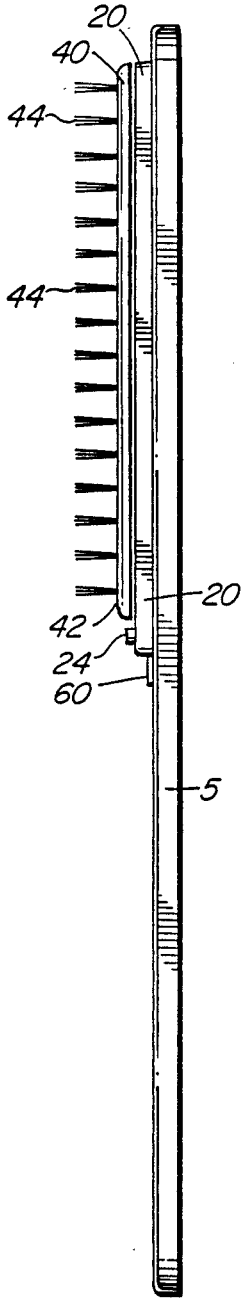
FIG. 2 is a side elevation view of the brush apparatus shown in FIG. 1.
Figure 3:
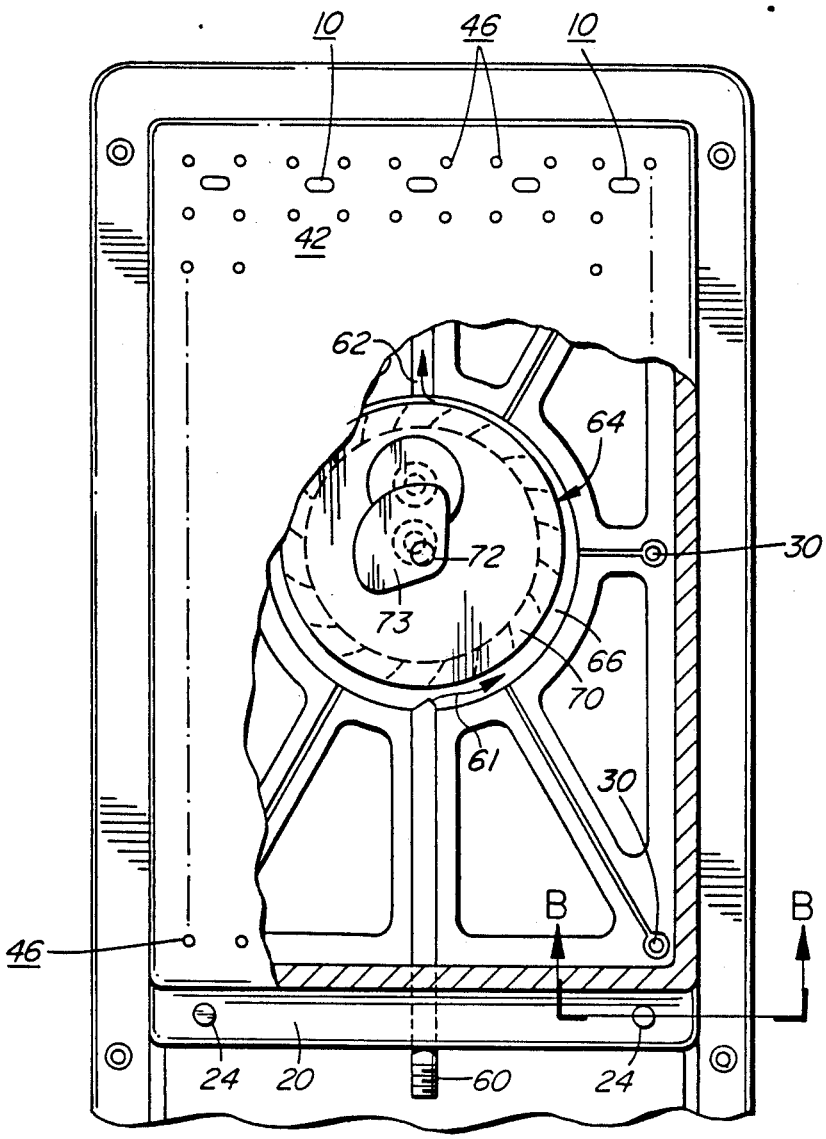
FIG. 3 is a front elevation partially cut-away of the body scrubbing brush shown in FIG. 1.

Brush panel 40 has a front brushing surface 42 including a plurality of groups of bristles 44 (shown only in FIGS. 2 and 4) which protrude outwardly from a gridwork of horizontally and vertically spaced bristle holes 46 in surface 42. Panel 40 is connected to base support 20 by a plurality of flexible rubber posts 30 which provide holding support for panel 40 in relation to base support 20 while permitting limited movement of the panel (as is described below in more detail).

Figure 4:
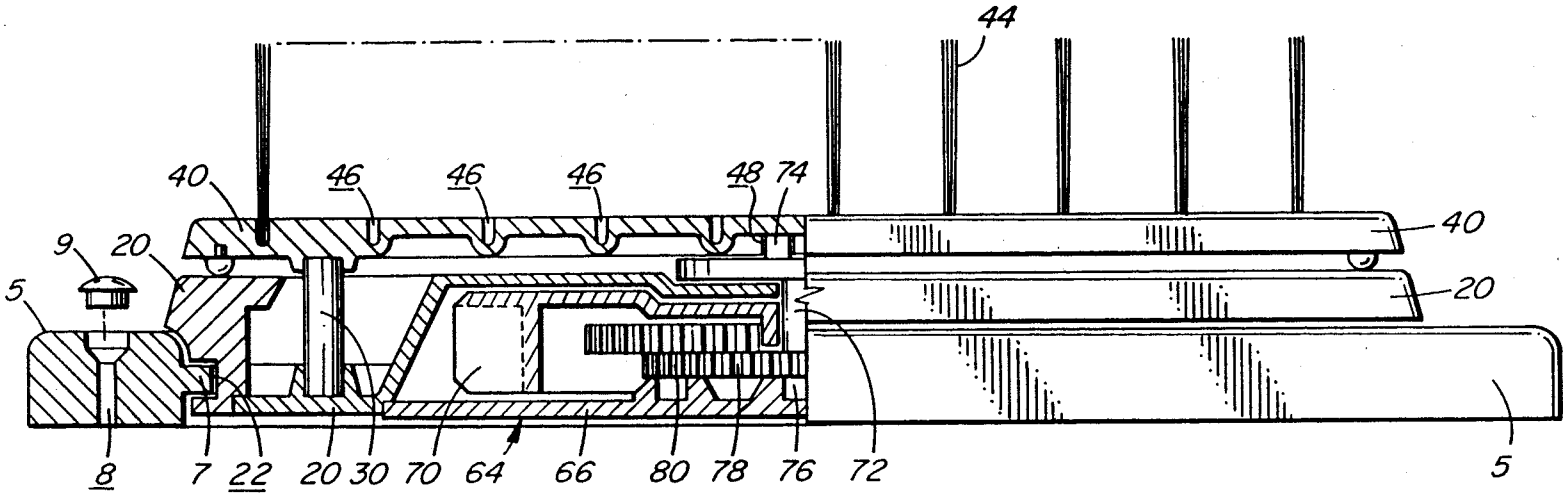
FIG. 4 is a top partial section view taken along line A—A in FIG. 1.
Figure 5:
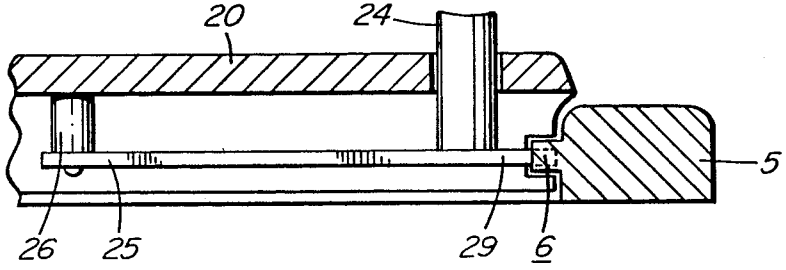
FIG. 5 is a detail section view taken along line B—B in FIG. 3.

The position of brush panel 40 is vertically adjustable within outer frame 5. As best seen in FIG. 4, a tongue 7 protruding inwardly from frame 5 slidingly engages a corresponding groove 22 which extends along the side edge of base support 20. The same arrangement exists on each side of the apparatus thus enabling the panel 40 to be raised or lowered within the frame. The particular position of the panel within the frame is controlled by a pair of pushbuttons 24. Each pushbutton is fixedly connected at one end 25 to a post 26 (see FIG. 5) formed on base support 20, and releasably engages a slot 6 in frame 5 at its opposed end 29. By simultaneously depressing pushbottons 25, the engagement is released. The panel may then be moved to another position, the number of available positions depending on the number of slots 6 provided in frame 5.

The provision for vertical adjustment of panel 40 within frame 5 is considered to be a desirable feature. Once the frame is mounted on a wall, such adjustment allows apparatus 1 to better accommodate differing heights of different users.

Frame 5 includes a plurality of screw holes 8 to enable apparatus 1 to be screwed to a wall. A cap 9 (see FIG. 4) is associated with each screw hole and merely serves to cover the head of the screw (not shown) once the screw is inserted.

Reference has been made to rubber posts 30 which permit limited relative movement between brush panel 40 and base support 20. In this regard, it will be appreciated that any force tending to move panel 40 within its own plane from the position illustrated in FIG. 4 will cause the posts to bend. The permitted distance of such movement will obviously be governed by the length and flexibility of the posts but, otherwise, the precise nature of the movement will be a function of the control which directs the movement. As discussed hereinbefore, the desired movement is a true scrubbing action. Such action does not require movement over distances any greater than that permitted by rubber posts 30 and accordingly the structure of apparatus 1 as has been discussed thus far is particularly suited to enable such action.

A true scrubbing action occurs when brush panel 40 moves in a small orbital path relative to an axis extending perpendicular in relation to base support 20 (and frame 5). The orbital path is small in the sense that the area described within the orbit path is substantially less than the area of the brush surface. (The maximum orbit path area would be the area centered on any one of rubber posts 30 and then described if the post was flexed sideways the maximum permitted distance in all directions.) When movement of panel 40 occurs in an orbital path, the panel is not rotating. Rotation would be considered undesirable in any event and, obviously, the connection between panel 40 and base support 20 by means of rubber posts 30 will not permit rotation.

Brush panel 40 is moved in an orbital path by means of a hydraulic drive mechanism which comprises a water inlet or pipe 60 for receiving a flow of water under pressure from a source (not shown) of pressurized water, a water outlet at 62 for discharging such water, and a transmission generally designed 64 connected between inlet 60, outlet 62 and brush panel 40. Water exiting through outlet 26 is directed to discharge through holes 10 opening across the top front surface 42 of panel 40. Transmission 64 comprises a circular end plate 66 mounted to base support 20, the end plate itself supporting an impeller gear or turbine 70 which receives and rotates in response to the flow of water at 61 from pipe 60, and an output drive shaft 72 offset and coupled at one end 74 to brush panel 40 and at its opposed end 76 to an output drive gear 78. Drive gear 78 and impeller gear or turbine 70 are interconnected by a gear reducer 80 which is also supported by end plate 66.

When impeller gear 70 rotates, gear reducer 80 and drive gear 78 rotate in turn. In response, the lower end 76 of shaft 72 turns on the axis of gear 78 and shaft end 74 orbits the same axis. Brush panel 40 follows the orbiting path of shaft end 74.

It should be noted that the coupling between shaft end 74 and brush panel 40 is a slide coupling which freely permits the shaft to rotate within hole 48 in panel 40. Hole 48 is sized to slidingly receive end 74 of shaft 72. It will also be noted that shaft 72 includes a counterbalance 73, the purpose of which is to counteract the imbalance at shaft end 74 and thereby reduce vibration as shaft 72 rotates.

As well, it should also be noted that there are a plurality of buttons or rub domes 49 (see FIG. 4) positioned on the back of brush panel 40 in juxtaposition with base support 20. Normally, such domes sit slightly spaced away from base support 20. However, when the apparatus is in use, brush panel 40 may be pressured by the user towards the support. It is desirable to limit such movement and at the same time to minimize frictional engagement when the limit is reached. The spacing between domes 49 and support 20 establishes the limit, and the curvate surfaces of the domes serve to minimize friction.

While the invention has been described with reference to the particular embodiment shown in the drawings, it will be understood by those skilled in the art that a variety of modifications and changes are possible within the spirit and scope of the following claims. The invention should not be considered as limited to the particular embodiment that has been shown.

I claim:

1. A body scrubbing brush apparatus, comprising:

(a) a base support;

(b) a brush panel having a front brushing surface, said panel being connected to said base support for non-rotational movement in an orbital path relative to an axis extending perpendicular to said base support; the area described within said orbit path being substantially less than the area of said brushing surface and, (c) an hydraulic driving means mounted to said base support, said driving means including:

(i) a water inlet for receiving a flow of water under pressure from a source of pressurized water;

(ii) a water outlet for discharging water so received; and, (iii) a transmission operatively connected between said inlet, said outlet, and said panel for moving said panel in said orbital path in response to the flow of water from said inlet to said outlet.

2. Apparatus as described in claim 1, further including:

(a) an outer frame, and means for mounting said base support within said outer frame; and, (b) means for mounting said outer frame to a wall to hold said panel in a vertical plane.

3. Apparatus as defined in claim 2, including means for adjusting the vertical position of said base relative to said frame.

4. Apparatus as defined in claim 1, wherein said panel is connected to said base support by a plurality of flexible posts, said posts providing holding support for said panel relative to said base support while permitting movement of said panel in said orbital path.

5. Apparatus as defined in claim 1, wherein said transmission comprises:

(a) an impeller gear for rotating in response to said flow of water, and;

(b) an output shaft coupled axially at one end with an output drive gear and coupled axially offset at an opposed end with said panel, said drive gear being coupled to said impeller gear for rotation in response to rotation of said impeller gear.

6. Apparatus as defined in claim 5, including gear reduction means coupled between said impeller gear and said drive gear.

7. A body scrubbing brush apparatus, comprising:

(a) a base support;

(b) a brush panel having a front brushing surface, said panel being connected to said base support for non-rotational movement in an orbital path relative to an axis extending perpendicular to said base support; the area described within said orbit path being substantially less than the area of said brushing surface;

(c) an outer frame, and means for mounting said base support within said outer frame;

(d) means for mounting said outer frame to a wall to hold said panel in a vertical plane; and, (e) a panel driving means operatively connected to said panel for moving said panel in said orbital path.

* * * * *